US007420521B2

(12) United States Patent
Hauck

(10) Patent No.: US 7,420,521 B2
(45) Date of Patent: Sep. 2, 2008

(54) WIDEBAND SEGMENTED DIPOLE ANTENNA

(75) Inventor: Bryan L. Hauck, West Warwick, RI (US)

(73) Assignee: Applied Radar Inc., North Kingstown, RI (US)

( * ) Notice: Subject to any disclaimer, the term of this patent is extended or adjusted under 35 U.S.C. 154(b) by 82 days.

(21) Appl. No.: 11/650,616

(22) Filed: Jan. 8, 2007

(65) Prior Publication Data

US 2008/0165077 A1 Jul. 10, 2008

(51) Int. Cl.
*H01Q 21/00* (2006.01)
*H01Q 9/16* (2006.01)
*H01Q 1/32* (2006.01)

(52) U.S. Cl. ..... 343/817; 343/817; 343/818; 343/825; 343/833; 343/792

(58) Field of Classification Search ..... 343/817, 343/818, 833, 834

See application file for complete search history.

(56) References Cited

U.S. PATENT DOCUMENTS

| | | | | |
|---|---|---|---|---|
| 3,656,167 | A * | 4/1972 | Lea | 343/793 |
| 3,716,867 | A * | 2/1973 | Mayes et al. | 343/701 |
| 5,969,690 | A * | 10/1999 | Yamabayashi et al. | 343/792 |
| 6,100,848 | A * | 8/2000 | Hayes | 343/702 |
| 6,407,719 | B1 * | 6/2002 | Ohira et al. | 343/893 |
| 6,515,634 | B2 * | 2/2003 | Desclos et al. | 343/818 |
| 6,633,263 | B2 * | 10/2003 | Bettin et al. | 343/725 |
| 6,917,340 | B2 * | 7/2005 | Lindenmeier | 343/725 |
| 6,987,493 | B2 * | 1/2006 | Chen | 343/893 |

OTHER PUBLICATIONS

Antenna Engineering Handbook, 3rd Edition, Richard C. Johnson, Publisher, pp. 4-1 to 4-34.

* cited by examiner

*Primary Examiner*—Trinh V Dinh
(74) *Attorney, Agent, or Firm*—Maurice M. Lynch

(57) ABSTRACT

A wideband antenna comprised of two or more conductive segments that are parasitically coupled.

1 Claim, 4 Drawing Sheets

WIDEBAND SEGMENTED DIPOLE ANTENNA

CROSS-REFERENCE TO RELATED APPLICATIONS

None

THIS IS NOT FEDERALLY SPONSORED RESEARCH FIELD OF INVENTION

This invention is related to methods of constructing radio frequency antennas useful for a variety of applications.

BACKGROUND OF INVENTION

Wideband radio frequency antennas are today constructed using spiral and log-periodic design techniques. These antennas are often of the wrong form for mobile applications with truck and other land based vehicles. For example, a spiral antenna is not suitable for mounting on the bumper of a truck. Also, the preferred installation method may not support a desired configuration of beam patterns. Antennas that do provide the desired mounting configuration are often of limited and relatively narrow bandwidth.

SUMMARY OF INVENTION

It is therefore the object of this invention to this invention to provide an antenna that has a wide transmit bandwidth and that provides a selection of new installation configurations suitable to a variety of applications.

It is also the object of this invention to provide a selection of beam patterns while maintaining suitable connection impedance.

It is an object of this invention to provide a whip-type antenna for a command and control vehicle, providing an ability to receive and transmit signals over a wide frequency range while reducing the need for additional antennas on said vehicle. The subject invention results from the realization than an easily deployable, compact wideband antenna is effected by the apparatus described in this application.

This invention features a segmented cylindrical antenna that has parasitically coupled elements arrayed in a linear fashion. These elements are of reasonably large diameter.

In a preferred embodiment, termed a segmented dipole antenna, there is included a symmetrical arrangement of parasitically couple antenna segments linearly arranged around a central feed point. Included is the matching network that provides the single to double ended feed for the antenna from a single coaxial cable.

In a second embodiment, termed a segmented monopole antenna, there is a set of parasitically coupled antenna segments linearly arranged from an end feed point. The end segment is electrically driven with radio energy while the ground is used for the second connection point for the coaxial cable.

DISCLOSURE OF PREFERRED EMBODIMENT

Figure 1:
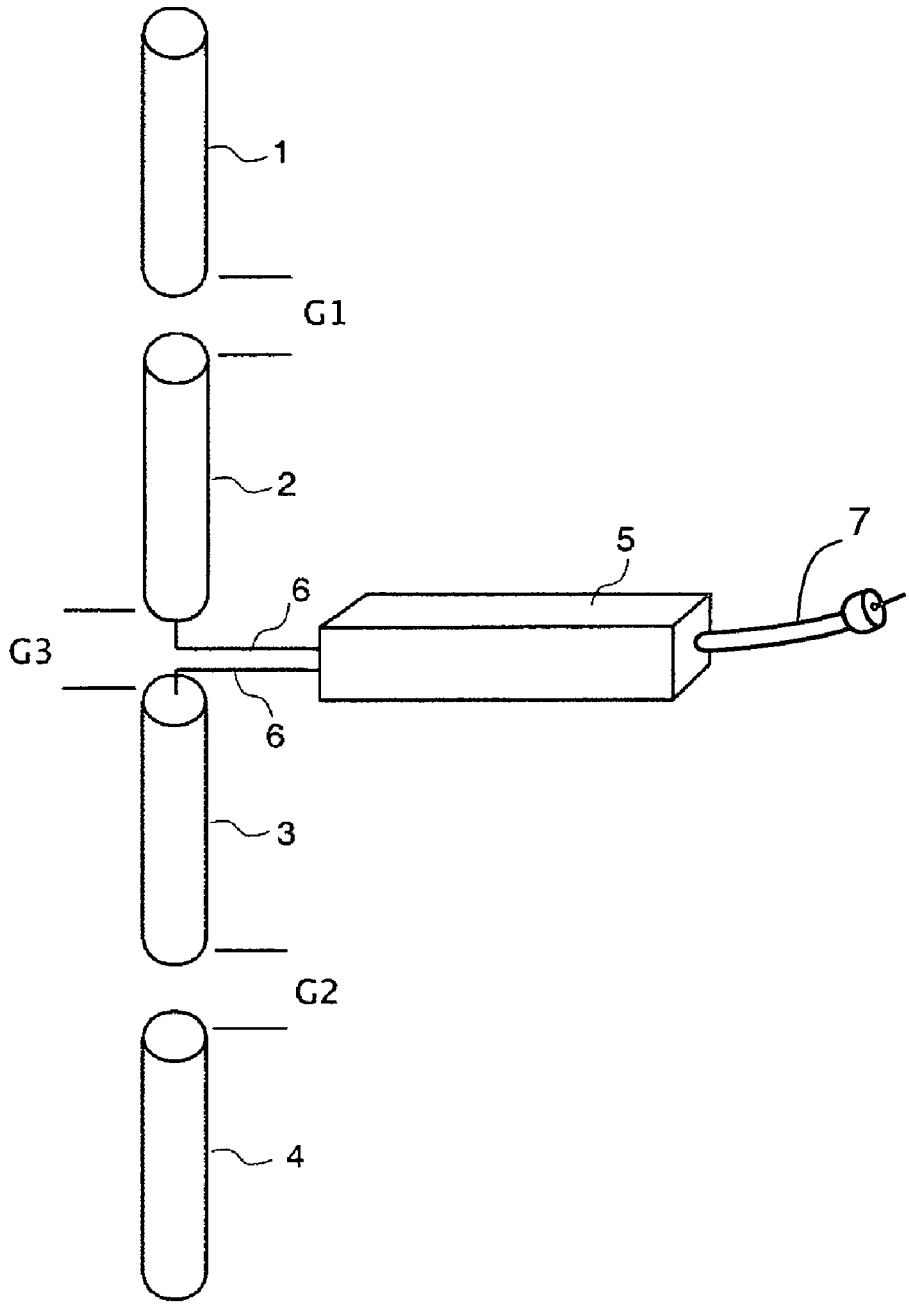
FIG. 1 is a diagram of the segmented dipole wideband antenna.

Other objects, features and advantages will occur to those skilled in the art from the following description of a preferred embodiment and the accompanying drawings, in which:

There shown in FIG. 1 a segmented dipole wideband antenna comprising conductive segments symmetrically arranged in a line about a central feed point. A first segment, 1, is parasitically coupled to a second segment, 2. The inside end of the second segment is connected to a balanced-to-unbalanced connection network 5, (balun) that provides the proper feed impedance for the coaxial cable 7. On the other side of the connection point is a third segment 3, of the antenna that is also connected to the balun. As in the case of segments 1 and 2, segment 3 is parasitically coupled to fourth segment 4. Between segments 1 and 2 and between segments 3 and 4 there are two gaps G1 and G2. Also, between segments 2 and 3 there is a third gap, G3. It is also a feature of this antenna that the segments are of a chosen diameter. In a preferred embodiment, the diameters of the segments that are equally displaced from the center connector are of the same diameters. There is shown in FIG. 1 a set of four antenna segments. However, it is evident that any even number of antenna segments might in fact be used. The design of this antenna consists of first constructing a dipole antenna as described in *Antenna Engineering Handbook*, Third Edition, Richard C. Johnson, editor, pages 4-1 to 4-34, for the center of the band over which the antenna is to operate. Such an antenna will have the largest diameter that is practical for the initial prototype. The length of symmetrically deployed gaps is then selected as is the length of the segments and input port reflection parameters are measured. The arrangement that best provides for a wideband transmission with a low input port refection is then chosen for the antenna design.

Figure 2:
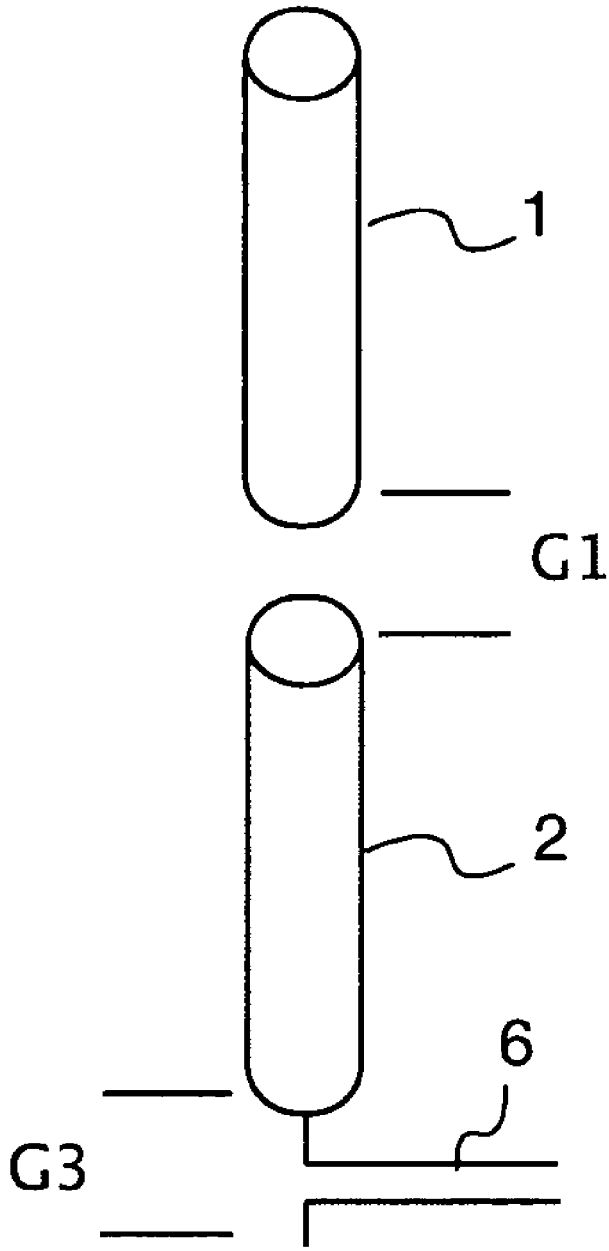
FIG. 2 is a diagram of the segmented monopole antenna.

Shown in FIG. 2 is a segmented monopole wideband antenna. This antenna is designed and constructed according to the same method as that of the dipole antenna above. However, this antenna is arranged asymmetrically about the ground plane of the mounting point. In this figure the parasitically coupled antenna element is 1, the gap between the elements is G1, and the electrically coupled element is 2. Gap G2 represents the gap between the monopole antenna and the ground plane and the feed lines are represented by 6.

Figure 3:
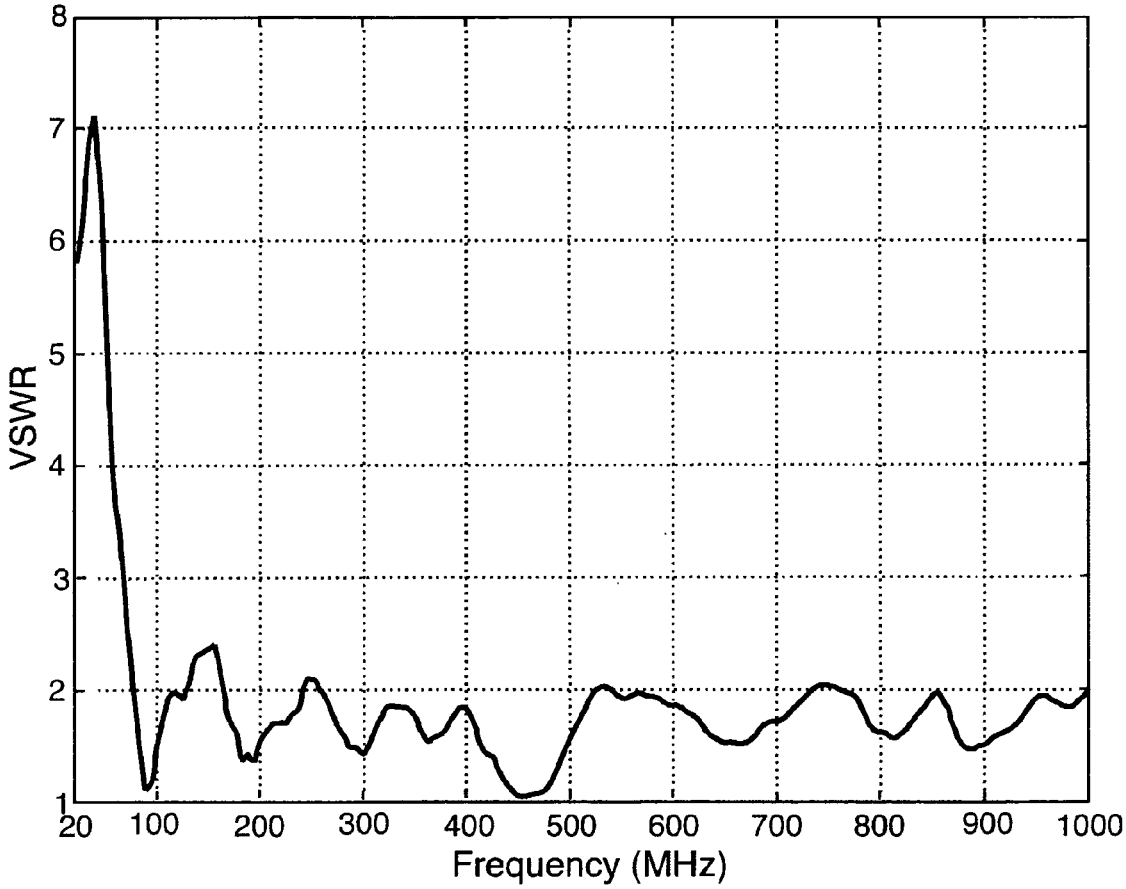
FIG. 3 is a graph of VSWR verses frequency.
Figure 4A:
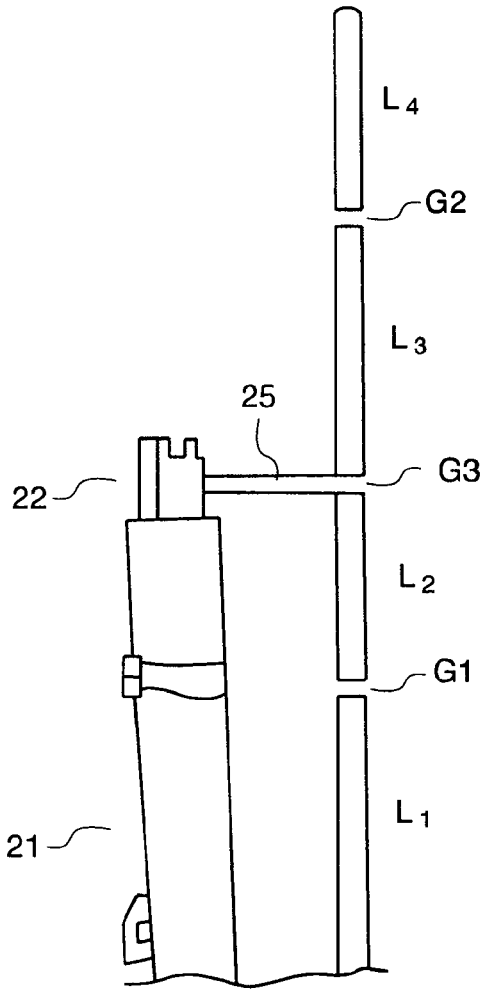
FIG. 4*a* is a diagram of an existing wideband segmented dipole antenna used for vehicles.
Figure 4B:
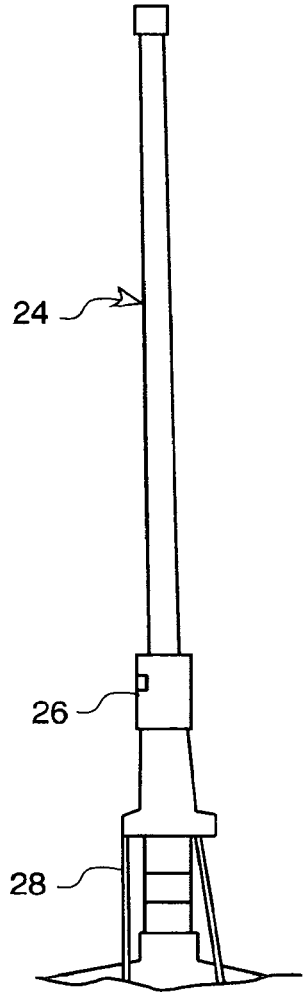
FIG. 4*b* is a diagram of a segmented wideband segmented dipole antenna on a test stand.

FIG. 3 depicts a graph plotting VSWR versus frequency with a ratio of 1 being optimal. FIG. 4*a* this invention as rigid segmented dipole antenna . . . It is attached to a test stand, 21, and power source, 22, through a coaxial feed to a matching impedance network. The rest of the antenna is labeled the same way as FIG. 1 to show the relationship between the two antennas. FIG. 4*b* depicts the outer housing for the antenna displayed in FIG. 4*a*, with outside covering and support 24, connector 26 and a shock mounting 28.

What is claimed is:

1. A wideband antenna comprised of two or more monopole segments aligned in an axis end to end;

each of said monopole segments is further comprised of an active component that connected to a feed line and to an inactive component which is parasitically connected to the active component to form a whip type antenna wherein the active components and the inactive components are aligned in the axis end to end.

* * * * *